US005094348A

United States Patent [19]

Harris et al.

[11] Patent Number: 5,094,348

[45] Date of Patent: Mar. 10, 1992

[54] DISPLAY STAND

[75] Inventors: Gregory A. Harris, Nashville, Tenn.; Robert W. Lackey, Hickory, N.C.

[73] Assignee: McCalla/Lackey Corporation, Hickory, N.C.

[21] Appl. No.: 692,016

[22] Filed: Apr. 26, 1991

[51] Int. Cl.[5] ..... A47F 5/00

[52] U.S. Cl. ..... 211/13; 211/60.1; 211/88

[58] Field of Search ..... 211/13, 131, 129, 60.1, 211/87, 194, 88

[56] References Cited

U.S. PATENT DOCUMENTS

| | | | |
|---|---|---|---|
| 727,107 | 5/1903 | Donaldson | 211/131 |
| 2,289,212 | 7/1942 | Rinnela | 211/131 |
| 2,632,267 | 3/1953 | Mitchell | 211/131 X |
| 3,266,634 | 8/1966 | Tintary | 211/131 |
| 3,833,128 | 9/1974 | Sumnar | 211/131 |
| 3,963,126 | 6/1976 | Taub | 211/131 |
| 4,006,559 | 2/1977 | Carlyon, Jr. | 211/131 |

FOREIGN PATENT DOCUMENTS

| | | | |
|---|---|---|---|
| 0857702 | 12/1970 | Canada | 211/131 |
| 1922116 | 11/1970 | Fed. Rep. of Germany | 211/131 |
| 2846034 | 5/1979 | Fed. Rep. of Germany | 211/129 |
| 2542594 | 9/1984 | France | 211/13 |

*Primary Examiner*—Robert W. Gibson, Jr.
*Attorney, Agent, or Firm*—Bailey & Hardaway

[57] ABSTRACT

A novel display stand is provided for supporting and displaying elongated objects which comprises a plurality of stacked semi-conical members defining spaces therebetween for insertion of elongated objects.

4 Claims, 2 Drawing Sheets

FIG. 1
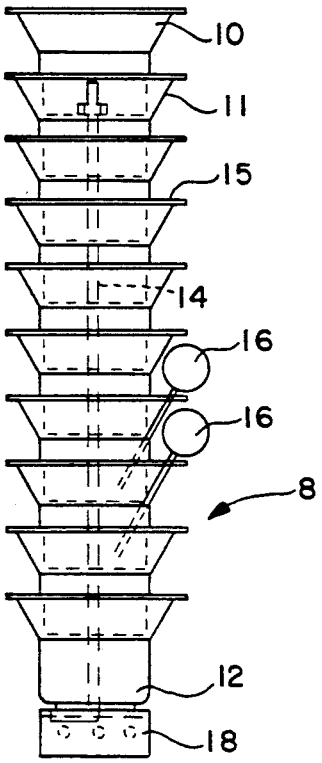
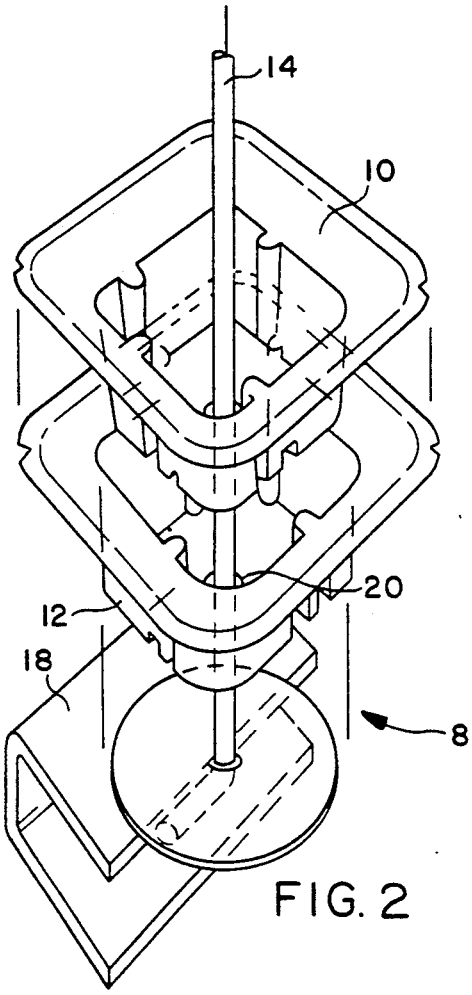
FIG. 2
FIG. 1a
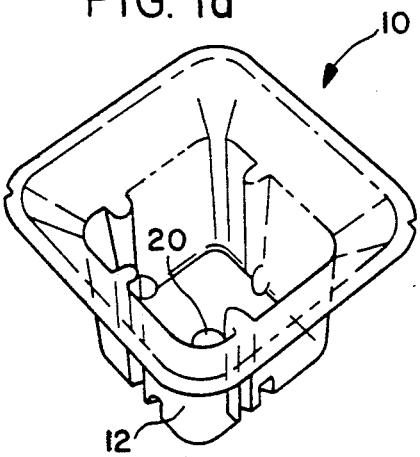
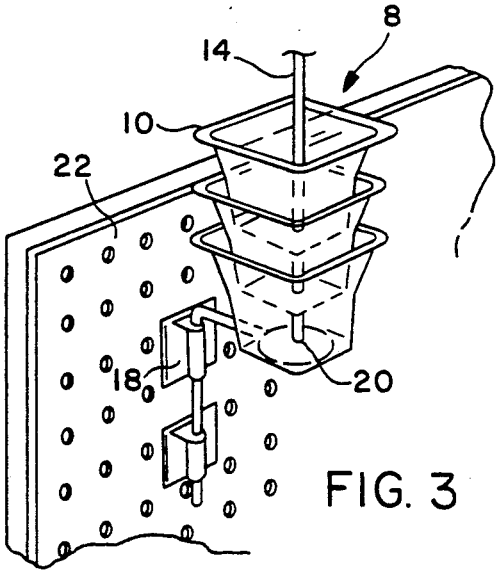
FIG. 3

DISPLAY STAND

BACKGROUND OF THE INVENTION

This invention relates generally to the art of display stands and, more particularly, to the art of display stands for supporting and displaying elongated objects.

The display of elongated objects for merchandising purposes has long been a difficult task due to the value of retail shelf space. Frequently, elongated objects, such as lollipops, candies and the like, have simply been displayed from large boxes or tubs where the dispensing is frequently unattractive and inefficient. Other arrangements have involved the use of display cards and the like which are even less efficient.

A vertically oriented display stand as described in U.S. Design Patent U.S. Pat. No. 75,081 is directed to an elongated stand, however, such would not be useful for the display and dispensing of elongated objects such as lollipops. While the prior art has devised ways of displaying and dispensing elongated objects such as lollipops and candies, there is a need for improvement in the art.

SUMMARY OF THE INVENTION

It is thus an object of this invention to provide a novel display stand for supporting and displaying elongated objects.

It is a further object of this invention to provide such a stand which can independently support itself or can be attached to a foundation.

It is a yet further object of this invention to provide such a display stand to which a header merchandising card can be attached.

These as well as other objects are accomplished by a display stand comprising a plurality of semi-conical members stacked upon one another with aligned holes in the centers thereof. A rod passes through the aligned holes to support the stacked members in a spaced relationship with the space therein adapted to retain and display elongated objects such as lollipops.

BRIEF DESCRIPTION OF THE DRAWINGS

FIG. 1 is a perspective view in partial phantom of the display stand with elongated objects therein.

FIG. 1*a* is an isolated perspective view of one of the members assembled in FIG. 1.

FIG. 2 is an assembly view, of the display stand.

FIG. 3 is a perspective view of the display stand attached to a foundation.

DETAILED DESCRIPTION

Figure 4:
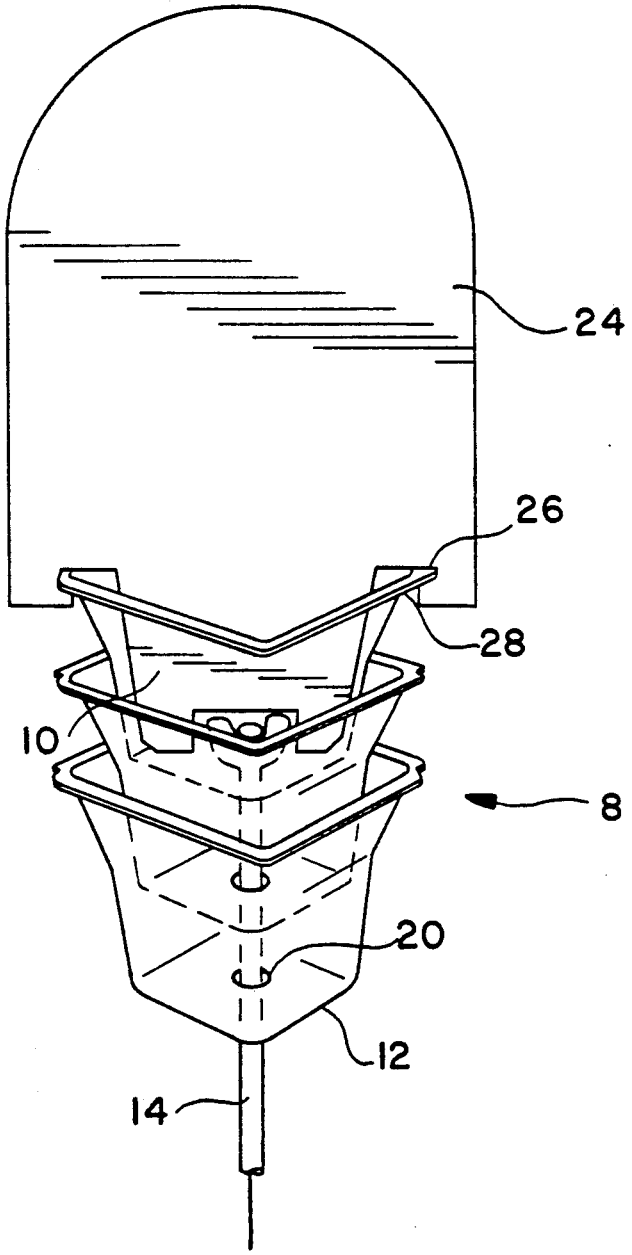
FIG. 4 is a perspective view of the display stand having a header attached at the top thereof.

In accordance with this invention it has been found that a novel display stand is provided which can support and display elongated objects such as lollipops for the merchandising thereof. It has further been found that the display stand according to this invention can stand freely or be attached to a foundation.

Various other advantages and features will become apparent from the following description given with reference to the various figures of drawings.

FIG. 1 of the drawings is a perspective view in partial phantom of the display stand 8 according to this invention. The display stand 8 is shown assembled and comprises a plurality of semi-conical members 10 stacked upon one another. Each semi-conical member 10 has a bottom base portion 12 shown in phantom that partially nests into another of the semi-conical members such as 11 in a stackable and nesting fashion.

A rod 14, shown in phantom, passes through the stacked semi-conical members 10 to support the stacked members 10 in a spaced relationship. Once so stacked, the semi-conical members such as 10 and 11 define a space 15 therebetween such that elongated objects 16, seen in partial phantom, can be inserted through the spaces and held for display. It is envisioned that many different elongated objects can be inserted in the spaces between the stacked members 10. Also shown in FIG. 1 is means 18 for attaching the display stand 8 to a foundation. Means 18 can also be constructed such that it can independently support the display stand.

FIG. 2 of the drawings is an assembly view of the display stand 8. The semi-conical members 10 have base portions 12 which are more clearly illustrated than in FIG. 1*a*. Each semi-conical member 10 defines a hole 20 at the center of the bottom base portion 12. The members 10 are stacked one upon another such that the holes 20 are aligned and rod 14 passes through each of the aligned holes 20 to support the stacked members 10 in a spaced relationship. Rod 14 is shown attached to means 18 for attaching the display stand 8 to a foundation. Once stacked as the assembly view shows, the semi-conical members 10 define spaces therebetween such that elongated objects can be inserted within the spaces.

FIG. 3 is a perspective view of the display stand 8 attached to a foundation 22. Foundation 22 is illustrated as a pegboard. Once again, the display stand 8 is supported by means 18. As illustrated, the display stand 8 comprises a plurality of stacked semi-conical members 10 in an aligned position. A rod 14 passes through holes 20 of the stacked members 10 to support the stacked members 10 in a spaced relationship.

FIG. 4 of the drawings is a perspective view showing another feature of the present invention. As illustrated, the display stand 8 comprises a plurality of stacked semi-conical members 10 with bottom base portions 12 and aligned holes 20. A rod 14 passes through the aligned holes 20 to support the stacked members 10 in a spaced relationship, and it is through these spaces that elongated objects can be inserted for support and display. The novel feature shown in FIG. 4 is the attachment of a header merchandising card 24 to the tip of the display stand 8. It is envisioned that many methods of attaching a header merchandising card 24 can be used although FIG. 4 utilizes placement of a central portion of the header merchandising card 24 in the top semi-conical member 10 and utilizes edges 26 of the header merchandising card 24 to attach the merchandising card 24 to the edges 28 of the semi-conical member 10.

It is thus seen that the present invention provides a novel display stand for supporting and displaying elongated objects. It is also seen that the present invention provides such a display stand which can independently support itself or can be attached to a foundation. It is further seen that the present invention provides such a display stand to which a header merchandising card can be attached. Many variations are apparent to those of skill in the art, and such variations are embodied within the spirit and scope of the present invention as measured by the following appended claims.

We claim:

1. A display stand comprising:

a plurality of hollow semi-conical members each having a bottom base portion;

said semi-conical members defining holes in said bottom base portions;

said hollow-semi-conical members being in a stack with one another with said holes aligned, said semi-conical members being stacked such that the bottom base portions of each are partially nested in a lower semi-conical member within said stack;

a rod passing through said aligned holes of said stack to support said stack of semi-conical members in a spaced relationship; and said stack of semi-conical members defining spaces therebetween such that elongated objects can be inserted within said spaces and held for display.

2. The stand according to claim 1 further including means to attach said rod with said stack of semi-conical members thereon to a foundation.

3. The stand according to claim 1 further including means for independently supporting said rod with said stack of semi-conical members thereon.

4. The stand according to claim 1 further including means for supporting a header merchandising card attached at the top of said stack of semi-conical members.

* * * * *